US006886251B1

(12) United States Patent
Andrews

(10) Patent No.: US 6,886,251 B1
(45) Date of Patent: May 3, 2005

(54) BEAM FABRICATION SYSTEM

(75) Inventor: Robert S. Andrews, Forrest City, AR (US)

(73) Assignee: VP Buildings, Inc., Memphis, TN (US)

( * ) Notice: Subject to any disclaimer, the term of this patent is extended or adjusted under 35 U.S.C. 154(b) by 321 days.

(21) Appl. No.: 10/095,511

(22) Filed: Mar. 11, 2002

Related U.S. Application Data

(63) Continuation of application No. 09/774,764, filed on Jan. 31, 2001, now abandoned.

(51) Int. Cl.[7] ..... B21D 47/01

(52) U.S. Cl. ..... 29/897.35; 29/897.31; 29/407.1; 29/430

(58) Field of Search ..... 29/897.35, 469, 29/525.13, 525.14, 711, 712, 897.3, 417, 897.31, 897.312, 407.09, 431, 407.1, 429, 714, 783, 785, 786, 787, 791, 792, 793, 794, 795, 819, 779, 822, 33 R, 33 K, 33 S, 33 P, 33 Q; 228/170, 5.1, 144

(56) References Cited

U.S. PATENT DOCUMENTS

| | | | | |
|---|---|---|---|---|
| 3,421,677 A | | 1/1969 | Jenkins | |
| 3,546,772 A | * | 12/1970 | McConnel | 29/430 |
| 3,616,091 A | * | 10/1971 | Troutner | 156/560 |

(Continued)

FOREIGN PATENT DOCUMENTS

| | | | |
|---|---|---|---|
| JP | 6-142920 | * | 5/1994 |
| WO | WO 94/27760 | * | 12/1994 |

OTHER PUBLICATIONS

Website, *Meeting the Demands of the Metal Building Industry*, Franklin Manufacturing, Inc., 3 pps. (Sep. 6, 2000), sections taken from "Metal Construction News" Apr. 1997.

Website, *Model PTW Horizontal Welding Systems*, Franklin Manufacturing, Inc., 3 pps (Aug. 3, 2000), and layout drawing (Apr. 1998).

Website, *NA–3 Automatic Wire Feeder*, Lincoln Electric, 2 pps. (Sep. 6, 2000), copyright 1999, 2000.

Website, CNC Gantry Systems, Franklin Manufacturing Inc., one page (Sep. 16, 2000) (used more than one year before the filing date of the present application).

Website, *Model–RM Flange Line*, Franklin Manufacturing, Inc., 2 pps. (Sep. 6, 2000) (first date of publication unknown).

*Primary Examiner*—Charles T. Jordan
*Assistant Examiner*—T. Nguyen
(74) *Attorney, Agent, or Firm*—Harrison & Egbert

(57) ABSTRACT

A method of making steel beams in accordance with the present invention comprises sending web fabrication information to a web cutting station indicative of web sizes needed to make webs for steel beams and indicative of a web discharge sequence in which the webs are to be discharged from the cutting station. Steel plate is cut at the cutting station to form webs having the indicated web sizes. A series of the webs are transported from the cutting station to a beam station according to the web discharge sequence. Flange fabrication information is sent to a flange station indicative of flange sizes needed to make flanges for the beams and a flange discharge sequence in which the flanges are to be discharged from the flange station corresponding to the web discharge sequence. Steel stock is cut so as to form flanges having the indicated flange sizes. The flanges are transported to the beam station according to the flange discharge sequence so as to match the flanges with an associated one of the webs. The flanges and the webs are welded together to form beams at the beam station. Also included is a cutting station conveyor for alternating the elevation of slats and conveyor rollers during the web cutting process and a method of cutting webs using the conveyor.

6 Claims, 8 Drawing Sheets

U.S. PATENT DOCUMENTS 3,639,962 A * 2/1972 Gooder ..... 29/897.31
3,673,658 A * 7/1972 Hagen ..... 29/897.3
3,860,761 A * 1/1975 Aschauer et al. ..... 219/83
3,894,908 A * 7/1975 Troutner et al. ..... 156/560
4,570,049 A 2/1986 Albert et al.
4,586,646 A * 5/1986 Booher ..... 228/44.3
4,633,055 A 12/1986 Conley
4,740,668 A 4/1988 Perez
4,850,522 A 7/1989 Nichols
4,983,241 A 1/1991 Sawada et al.
5,074,457 A 12/1991 Matsuki et al.
5,123,587 A * 6/1992 Ashmore ..... 228/170
5,145,102 A 9/1992 Minato et al.
5,501,752 A * 3/1996 Owens et al. ..... 156/64
5,506,387 A 4/1996 Sawada et al.

* cited by examiner

BEAM FABRICATION SYSTEM

RELATED APPLICATIONS

The present application is a continuation application of U.S. Ser. No. 09/774,764, filed on Jan. 31, 2001, entitled "BEAM FABRICATION SYSTEM", Now abandoned.

FIELD OF THE INVENTION

This invention relates to the fabrication of steel beams used as structural members in building construction.

BACKGROUND OF THE INVENTION

I beams comprise two parallel flanges and a central web extending between them. In a typical method of making steel I beams, the flange line drives the making of webs. That is, the flanges for several jobs are all made out of the same thickness of bar stock material, and stacked in the intended order of use at a tack welding station. A group of flanges may be made from one size of bar stock. These flanges are numbered in the order they are produced, pairs of flanges, inside and outside, being made for each beam. If another size of bar stock is then needed the flange numbers continue sequentially with flanges of that next pair. The webs that match these flanges are then produced at a web cutting station. The webs are made at the web cutting station in a manner that results in efficient utilization of the web stock Therefore, the webs may be nested together so as to include webs out of the sequence dictated by the flanges. When the webs are sorted and stacked in the same sequential order as the flanges, any webs out of sequence would be placed aside until its place in the sequence arises. The stacks of webs are numbered in a sequence that corresponds to the sequence of the stacked flanges.

Plates of web stock of a predetermined length are loaded by crane onto a water table at a cutting station. The cutting station may employ a plasma torch utilizing nitrogen cutting gas. The machine cuts a nest of webs out of individual plates of web stock which are available in different lengths. A computer "nesting" program determines the most efficient manner in which to cut webs of the desired size from the plate. At the cutting station there is a significant amount of scrap material that cannot be used to make the desired webs. The way the nesting software organizes the webs efficiently for cutting from individual plates results in waste known as "drop," which can be end drop or side drop depending on the location where it is generated. When the cutting is complete, a crane is used to remove the waste material, and the webs are sorted and stacked. The webs are stacked in a desired order of use, which matches the order of the flanges that have been made i.e., the web to be used first is on top of the stack, the next web to be used is disposed beneath it and so on. After the webs and scrap are removed from the cutting machine, the next plate of web stock is loaded into place and webs are cut from it in the same manner.

A stack of the webs is then moved near a conveyor at a seam welding station. Oftentimes, webs must have a length that is longer than the web stock. Such webs are made by seaming webs together end-to-end at the seam station. Otherwise, if no seam is required the webs are moved in the order in which they are stacked onto the conveyor near the seam station and pass by the seam station. The single and multipiece webs are conveyed past the seam station to a tack station where they are mated with the appropriate flanges in the order in which the flanges made at the flange station are stacked, and then two flanges are tack welded on either side of each web. The tack welded web and flanges are then conveyed to a beam welding station which welds the flanges to the web to form a beam. After the beam is formed it is removed from the exit conveyor after the beam welding station and matching detail parts are placed on it. The beam is transported by crane to a finish welding station where the detail parts are hand welded to the beam.

The conventional process is inefficient and wasteful. Workers are continuously using cranes to stack and unstack material and to transport and store the stacks. For example, the web portions which are cut from the web stock are sorted and stacked and then moved by crane to a seaming station to be welded together to form webs of longer length. The flanges are made and then sorted and stacked and moved by crane to the tack welding station.

Working with stacks requires equipment including lifting devices, chains, slings, and spreader bars, as well as storage space and crane operators. All of this stacking, unstacking, restacking and moving of stacks is undesirable because, although it is necessary for the conventional process, it adds nothing of value to the final beam. Despite the inefficiency of stacking, unstacking, moving and storing stacks of material, and the wastefulness and inefficiency of current methods of cutting webs and welding web portions together to make multi-piece webs, this process of making beams has been used in the industry for many years.

A disadvantage of this process is that many of the jobs ordered by builders are mixed together at one time. A builder may want a job placed at a high priority. However, that particular job is intermingled with other jobs and cannot be produced any quicker without extreme difficulty. Conversely, if production begins and then a builder contacts the beam manufacturer and indicates that he will not need the beams of his job completed soon, it is very difficult if at all possible to pull his low priority job from the fabrication cycle. As a result, the low priority job slows down the production of higher priority jobs.

The present invention enables webs to be made with good plate utilization, avoids making stacks and enables production to be more responsive to builders job priorities.

SUMMARY OF THE INVENTION

In general, the present invention is directed to a system for making steel beams. In the present invention information is sent to a cutting station for making webs needed for the beams, including information regarding web sizes and a sequence in which the webs are to be discharged from the cutting station to a beam station at which flanges and webs are welded together to make beams. The steel plate is cut at the cutting station to form the webs having the indicated web sizes. A series of the webs are transported from the cutting station to the beam station according to the web discharge sequence. Flange fabrication information is sent to the flange station indicative of flange sizes needed to make flanges for the beams and a flange discharge sequence in which the flanges are to be discharged from the flange station so as to correspond to the web discharge sequence. The flanges are cut to the indicated sizes from one piece of bar stock or two or more welded pieces of bar stock. The flanges are transferred to the beam station according to the flange discharge sequence so as to match the flanges with an associated one of the webs. The flanges and webs are welded together to form beams at the beam station. In the invention, the web cutting station drives beam fabrication, which offers advantages of producing beams based upon job priority while achieving good web plate utilization. Another advantage of the invention is that making stacks of webs and flanges, moving the stacks and unstacking the stacks, may be minimized or avoided altogether, which results in more efficient and cost effective beam fabrication.

More specific features of the invention are that the web fabrication information and the flange fabrication information comprise electrical signals sent from one or more computers, e.g., personal computers (PC's). The information may also take the form of hardcopies of the data which are delivered to the flange and cutting stations. In a preferred aspect of the invention the steel plate from which the webs are cut is a continuous steel plate comprised of at least two steel plates welded together. The webs are cut from the web plate using a plasma torch. The flanges are made and transported to the beam station without stacking of flanges between the flange station and the beam station. After the beams are formed at the beam station detail parts may be attached to them to form finished beams.

A preferred embodiment of a method of making steel beams according to the present invention comprises organizing a plurality of jobs based upon priority, each of the jobs being comprised of a plurality of steel beams. The web fabrication information is sent to the web cutting station and is indicative of web sizes needed to make webs for a job having highest priority and indicative of the web discharge sequence. The steel plate is cut at the web cutting station to form webs having the indicated web sizes. The series of webs are transported from the web cutting station to the beam station according to the web discharge sequence. The flange fabrication information is sent to the flange station. The steel stock is cut and flanges having the indicated flange sizes are formed. The flanges are transported to the beam station in the flange discharge sequence so as to match the flanges with an associated one of the webs. The flanges and webs are welded together to form beams at the beam station.

In a preferred aspect of the present invention the beams are fabricated on a job priority basis. By organizing the beams based upon job priority, the web fabrication signals may instruct the cutting of all of the webs of the highest priority job before cutting any webs of a job having lower priority. More preferably, to achieve desired plate utilization the web fabrication signals instruct the cutting of webs of the highest priority job along with at least one web from another job of different priority. That is, although the highest priority job may not have all webs cut at once and webs from another job may be cut during production of the first job to efficiently utilize the web plate, in general, webs of the first job are cut and sent to the beam line in a manner that maintains its priority. Mixing in webs from other jobs to achieve good plate utilization has an insignificant effect on slowing down the production of the highest priority job.

As used herein, the term "job priority" means producing one job before the next job in the sequence provided by production control, except to the extent to preserve desired plate utilization. This is characterized by making webs such that all or nearly all of the webs of the highest priority job are made before the webs of other jobs, except for webs that are made for the next priority job so as to ensure that the web stock plate is used efficiently in making the webs of the highest priority job.

An apparatus for making steel beams according to the present invention comprises a cutting apparatus adapted to cut webs from steel plate. A computer based cutting station controller is disposed near the cutting station. A beam station comprises welding apparatus for welding the flanges to the webs to form beams. A conveyor extending from the cutting station to the beam station is adapted to move webs cut at the cutting station to the beam station. A flange station adjacent the beam station is adapted to make flanges. Flanges are moved from the flange station to a conveyor at the beam station using a roller conveyor or other suitable conveyor known to those skilled in the art. Throughout this disclosure, reference to a conveyor means any conveying device for transporting steel plate, including conventional roller conveyor tables with independent motor drives. A computer based flange line controller is disposed at the flange station. A production control computer is electrically connected with the computer based cutting machine controller and the computer based flange station controller.

The production control computer has data input therein comprising:

(a) web fabrication data which can be downloaded to the computer based web cutting station controller, the web fabrication data comprising web sizes needed to make webs for steel beams and indicative of a web discharge sequence in which the webs are to be discharged from the web cutting station; and (b) flange fabrication data which can be downloaded to the computer based flange line controller, the flange fabrication data being indicative of flange sizes needed to make flanges for the steel beams and a flange discharge sequence in which the flanges are to be discharged from the flange station corresponding to the web discharge sequence.

More specific features of the apparatus are that it comprises a web seaming station comprising a welder for welding plates of web stock together to form a continuous plate. The web seaming station is disposed upstream of the cutting station. The cutting station is adapted to cut the webs from the continuous plate. A cutting station conveyor extends from the seaming station to the web cutting station and is adapted to convey the continuous plate to the web cutting station. The web cutting station comprises a plasma cutting machine.

Another aspect of the present invention is directed to the web cutting station conveyor. The cutting station conveyor comprises bars disposed on either side of a cutting station table and extending along a length of the table. Each of the bars rotatably carries first and second sets of rollers. At least one base member is disposed on either side of the table and carries base rollers which rotatably contact the bars. A conveyor roller carrier assembly comprises side members on both sides of the table. Conveyor rollers are rotatably carried between the side members. Below the conveyor rollers the side members comprise sloped cam surfaces. The side members may also comprise a lower surface and an upper surface extending below and above each cam surface, respectively. The cam surfaces of the conveyor roller carrier are adapted to contact the first set of rollers. A slat carrier assembly comprises side members disposed along both sides of the table and slats extending between the side members across the table. The slat conveyor side members comprise, below the slats, sloped cam surfaces. The slat carrier side members may also comprise a lower surface and an upper surface extending below each cam surface, respectively. The cam surfaces of the side members of the slat carrier are adapted to engage the second set of rollers.

A motorized drive engages the bars and is adapted to move the bars in a first direction along a length of the table and in a second direction opposite to the first direction while the bars are supported by the base rollers. The cam surfaces of the conveyor roller carrier and the cam surfaces of said slat carrier are spaced and configured relative to each other whereby movement of the bars in the first direction moves the first and second sets of rollers on the conveyor side member cam surfaces and the slat side member cam surfaces to move the conveyor rollers and the slats such that the slats are disposed above the conveyor rollers, and movement of the bars in the second direction moves the first and second sets of rollers on the conveyor side member cam surface and the slat side member cam surface to move the conveyor rollers and the slats such that the conveyor rollers are disposed above the slats.

A method of cutting steel plate using the cutting station conveyor comprises driving the cam bars in a first stroke so as to move the first and second sets of rollers in the first direction along a length of the table. The first sets of rollers are moved, as a result of moving the bars in the first direction, from contact with a lower position of the conveyor roller cam surfaces into contact with an upper position of the conveyor roller cam surfaces so as to lower the conveyor rollers rotatably connected to the conveyor roller side member and at least one steel plate supported on the conveyor rollers. The second sets of rollers are moved, as a result of moving the bars in the first direction, from contact with an upper position of the slat carrier cam surfaces into contact with a lower position of the slat carrier cam surfaces so as to raise the slats connected to the slat carrier side members above the conveyor rollers at an end of the first stroke. At this point the slats support the at least one plate above the conveyor rollers, which is cut while it is disposed on the slats, thereby forming cut shapes and scrap supported on the slats.

The bars are driven in a second stroke so as to move the first and second sets of rollers along the side portions of the cutting station table in the second direction opposite to the first direction. The first set of rollers are moved, as a result of moving the bars in the second direction, from an upper position of the conveyor roller cam surfaces to a lower position of the conveyor roller cam surfaces so as to raise the conveyor rollers. The second set of rollers are moved, as a result of moving the bars in the second direction, from a lower position of the slat carrier cam surfaces to an upper position of the slat carrier cam surfaces so as to lower the slats below the conveyor rollers at an end of the second stroke, thereby supporting the cut shapes and the scrap on the conveyor rollers.

More specific features of cutting the steel plate using the cutting station conveyor include using slat carrier plates including slots adapted to enable vertical movement of the conveyor rollers therein. Prior to movement of the bars in the first direction, at least one of the conveyor rollers may be driven to move the at least one plate toward a cutting area when the conveyor rollers are disposed above the slats. After the movement of the bars in the second direction, at least one of the conveyor rollers are driven to move at least a portion of the cut plate (e.g., cut webs and scrap) when the rollers are disposed above the slats.

More preferably, as the bars travel in the first direction to position -the slats above the conveyor rollers, the first set of rollers may travel from contact with the lower surfaces of the conveyor side members into contact with its upper surfaces. During this time the second set of rollers travel from contact with the upper surfaces of the slat side members to the lower surfaces thereof. As the bars travel in the second direction to position the conveyor rollers above the slats, the first set of rollers travel from contact with the upper surfaces of the conveyor side members to their lower surfaces. During this time, the second set of rollers travel from contact with the lower surfaces of the slat side members into contact with the upper surfaces thereof.

The invention is advantageous in that the beam fabrication system may be operated so that the web cutting station drives the flange station, thereby enabling beams to be made in order of jobs regardless of thicknesses of the flanges needed to be matched with the webs. In contrast, prior systems would make flanges from a bundle of bar stock having the same thickness, and would make beams for several jobs mixed together, regard less of the order of jobs. This required sorting and stacking of the webs and flanges and making the webs in response to the particular flanges that were needed. In the present invention the cutting machine cuts webs necessary for a particular job or jobs at a time. The thickness of the flanges may vary as required to fabricate webs in the order specified by web production. This is advantageous in that stacking and unstacking, storage and transport of stacks of webs and flanges is eliminated. Another advantage is that production proceeds according to job priority. The webs which are produced at the plasma cutting station are fed in a desired sequence to the beam line.

Many additional features, advantages and a fuller understanding of the invention will be had from the accompanying drawings and the detailed description that follows.

DETAILED DESCRIPTION OF PREFERRED EMBODIMENTS

Figure 1:
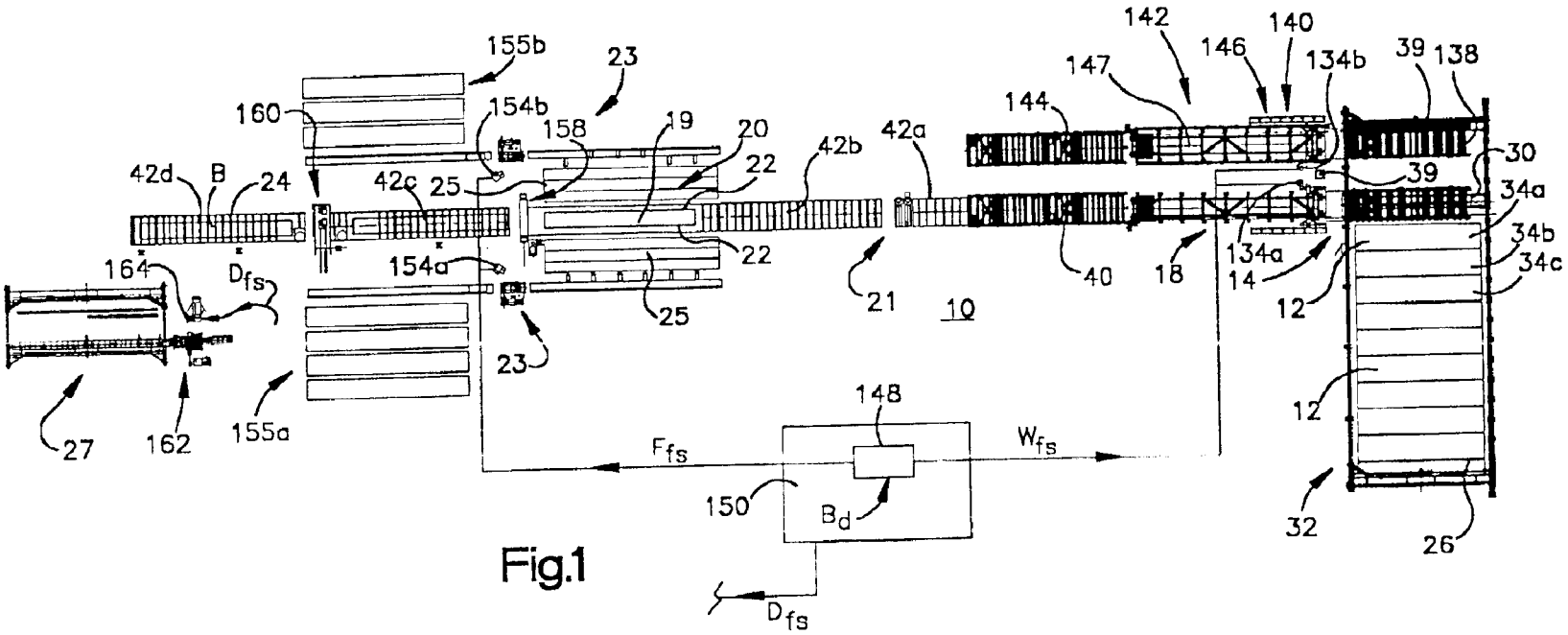
FIG. 1 is a schematic view of a beam fabrication system of the present invention.
Figures 2, 3A:
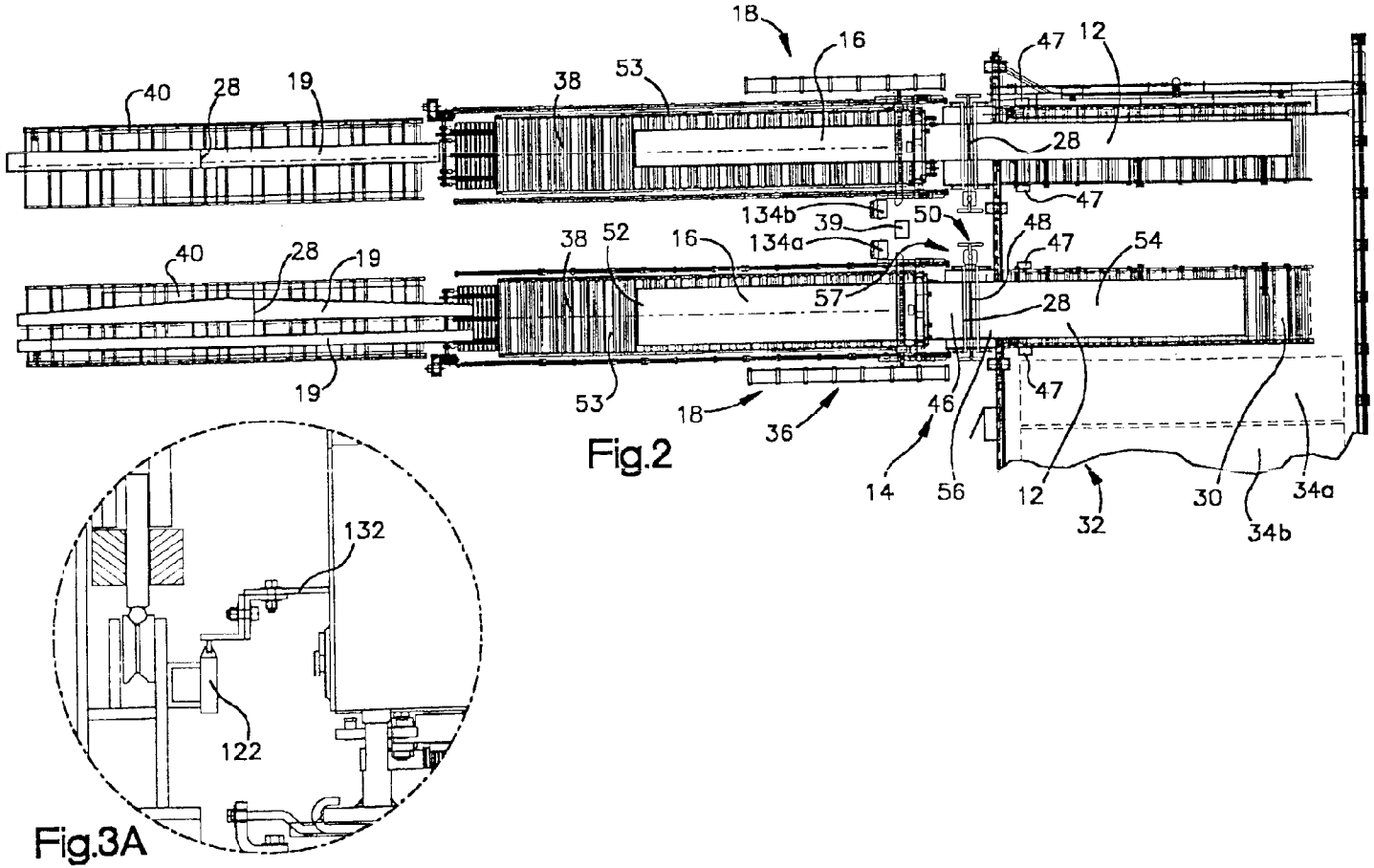
FIG. 2 is an enlarged view of seaming and cutting stations of the beam fabrication system shown in FIG. 1.
FIG. 3A is an enlarged view of a portion of FIG. 3.

As an overview of a preferred embodiment of the invention, referring now to the drawings, and to FIGS. 1 and 2 in particular, in the beam fabrication system 10 of the present invention plates of web stock 12 are fed to a web seaming station 14. At the web seaming station 14 adjacent plates of web stock are welded together end-to-end to form a continuous plate 16 (FIG. 2). The continuous plate is fed to a cutting station 18 and webs 19 are cut therefrom. The webs are then conveyed from the cutting station toward a beam station 20. If webs need to be seamed together this may be done at a second seam station 21. Flanges 22 are formed at a flange station 23 and then welded to the appropriate web to form beams B at the beam station. Detail parts prepared at a detail parts station 27 are attached to the beams to form finished beams.

More specifically, a storage table or area 26 is used for storing stacks of plates of web stock grouped according to size. At the web seaming station 14, plates of web stock 12 obtained from the storage table are welded together end-to-end at 28 to form a continuous plate. An infeed conveyor 30 extends between the storage table and the seaming station for moving the plates of web stock to the seaming station. A web gantry 32 is operated to automatically retrieve from the storage table a desired plate of web stock from a stack of web stock 34*a*, 34*b*, 34*c* . . . , containing the selected size of web stock, and places it on the infeed conveyor.

Figure 3:
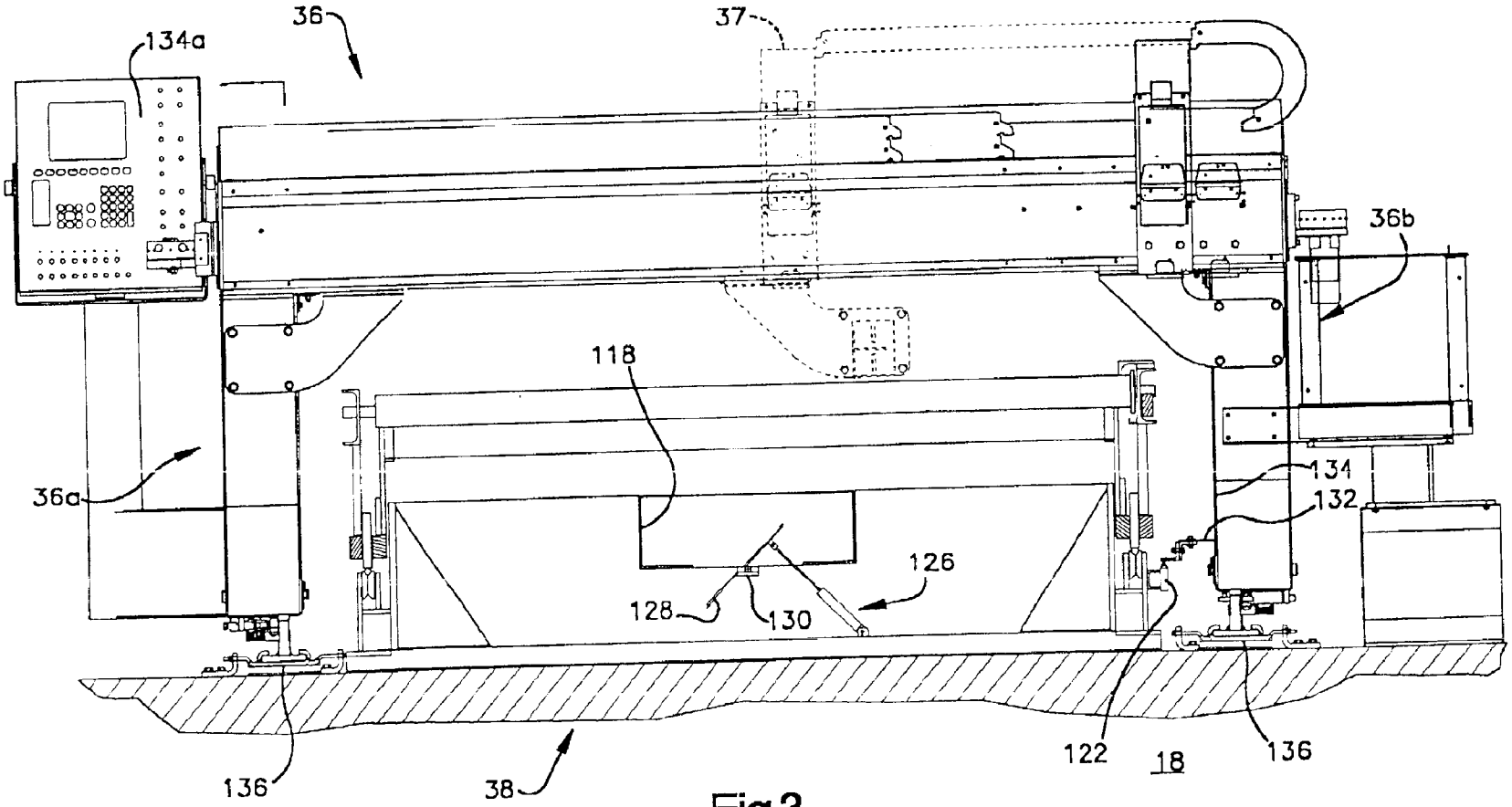
FIG. 3 is a side elevational view of a plasma cutting machine used in the present invention and a cutting station conveyor constructed in accordance with the present invention.

At the cutting station a cutting machine 36 is used for cutting webs from the continuous web plate 16 and comprises a cutting station gantry 36*a* and a torch 36*b* (FIG. 3) as is well known in the art. A cutting station conveyor 38 extends from the web seaming station 14 to the cutting station 18 for moving the continuous plate to a cutting area of the cutting station. Movement of the cutting station gantry 36*a* is in two opposite directions parallel to the extension of the cutting station conveyor and movement of a torch holder 37 is in two opposite directions perpendicular to the travel of the gantry (FIG. 3). An exit conveyor 40 extends from the cutting station conveyor for moving webs cut at the cutting station toward the beam station and on which the webs may be removed from the waste and sorted.

At the beam station, flanges are welded to the webs that have been cut at the cutting station. The beam station comprises the second seam welder 21, a tack welder 158 and a beam welder 160. A beam line conveyor 42 extends from the exit conveyor through the beam station and comprises components 42*a–d*. The flange station 23 comprises equipment on both sides of the beam line for making inner and outer flanges. A flange exit roller conveyor 25 is used to move flanges from the flange station to the beam station conveyor at the tack station. An operator makes flanges of a particular size corresponding to a size and sequence of webs moved to the beam station conveyor and conveys two of the flanges on either side of the web located on the beam station conveyor. At the beam station, welding apparatuses are used for tack welding the flanges to the web at tack station 158 and then welding to form a beam at beam welding station 160.

The detail parts station 27 makes detail parts to be attached to the beam and is located near the beam welder 140. A jib crane is used to remove the beams from an exit portion 42*d* of the beam line conveyor downstream of the beam welder 160 into a storage area near the beam welder. Here, the detail parts are placed on the corresponding beam. An overhead crane is then used to move the beams to a finish welding station for final welding of the detail parts to the beams. The detail parts are welded to the beams using hand welders such as 600 amp MIG welders.

More specific features of the beam fabrication system of the invention will now be described. The web gantry 32 supplies the infeed conveyor with rectangular plates of web stock of desired size from the storage table. The web stock is stacked according to size on the storage table. Once the operator selects the desired size of web stock at the gantry controls, grippers of the web gantry (not shown) are moved automatically to a desired plate of web stock in one of the stacks, lowered into gripping contact with the desired plate, activated, raised, moved above the infeed conveyor, lowered to the infeed conveyor 30 and then deactivated to release the plate onto the infeed conveyor. When activated, the web gantry grippers hold on to the first plate by means of a vacuum or magnetism. The plate is moved by the web gantry onto the infeed conveyor in position to travel in a direction of its length. In the system described herein although the use of continuous plate is preferred, those skilled in the art will realize in view of this disclosure that instead of using continuous plate webs may be cut from individual, unseamed plates and then the webs may be seamed together later, or two or more plates at a time may be seamed together and then webs cut therefrom.

A drive of the infeed roller conveyor is activated to rotate its rollers in the known manner and move the first plate toward the seaming station (FIG. 2). At an end of the infeed conveyor near the seaming station the first plate is squared with a plate squaring device 47 in a known manner by pushing a plate against a known datum line. Any suitable squaring device used to square plate on a conveyor against a known datum line may be used, such as a pneumatic type of such a squaring device manufactured by Franklin. The datum line is perpendicular to the plasma cutting gantry to a tolerance of, for example, +/−¼ inch. In the case where webs are typically nested of a width that does not fully approximate the plate width, tolerance of squaring is not critical. However, in the case of nesting which more closely approximates the plate width, manual squaring may be conducted at the cutting station once the plate is mechanically squared at the infeed conveyor. The squaring device may be powered by hydraulics, pneumatics or an electric motor, for example.

The first plate is indexed so that its trailing end 48 is positioned at a welding location 50 of the web seaming station. The leading end 52 of the first plate is received on conveyor rollers 53 of the cutting table conveyor 38 and is nearer the exit conveyor 40. A second plate of web stock 54 is then obtained from the storage area by the web gantry and placed onto the infeed conveyor in the same manner as the first. The drive of the infeed conveyor is activated, thereby rotating its rollers to move the second plate so that its leading end 56 is located at the end of the infeed conveyor. The second plate is squared with the pneumatic device and then the infeed conveyor drive is again activated, thereby indexing the second plate to the welding location 50 of the seaming station into abutment with the trailing end of the first plate. The first and second plates are clamped at the seaming station and welded by a seaming welding machine 57 together along their ends to form a weld 28. Suitable seam stations include a seam welder manufactured by PHI (having a width of at least 60 inches) and a weld splice station autowelder manufactured by Franklin. One suitable weld used in seaming web plates together end-to-end, is a submerged arc weld.

A web gantry controller 39 is used to operate the web gantry, to control the infeed conveyor, the exit conveyor and the squaring device. It includes a touch screen so that the operator presses one of a number of areas on the screen to cause the web gantry to retrieve web stock stored in a stack at that location.

The cutting station conveyor is activated to move the welded first and second plates forward toward the exit conveyor 40. The conveyor rollers of the cutting station conveyor may be driven alone or along with the infeed conveyor rollers to move the plate. When needed, another plate of web stock is then retrieved by the web gantry, placed on the infeed conveyor and moved to the seaming station. This plate is welded to the trailing end of the last plate (e.g., the second plate), to enable the fabrication of a continuous plate of web stock comprised of two or more plates. The process may change web stock size as desired.

The inventive system is adapted to make webs having uniform thickness throughout their length or webs which comprise more than one thickness. To make webs of a new thickness, a plate of web stock of new thickness is obtained by the web gantry 33 and placed on the infeed conveyor 30. The plate may be seamed onto the end of the last plate of the previous thickness which forms the end of the continuous plate. In this case webs that are cut from the continuous plate include two different thicknesses. Depending upon the application, a dual thickness web is sometimes desired. Alternatively, the process could begin again with a plate of new thickness, that plate being the first plate of a continuous plate of new thickness.

The cutting station conveyor preferably includes slats 59 (vertical plate-like members) which support the continuous plate on their ends and a device for moving the continuous plate. The webs are cut from the plate while it is supported by the slats. Any conveyor which includes slats for supporting the plate during cutting may be used.

Figure 4:
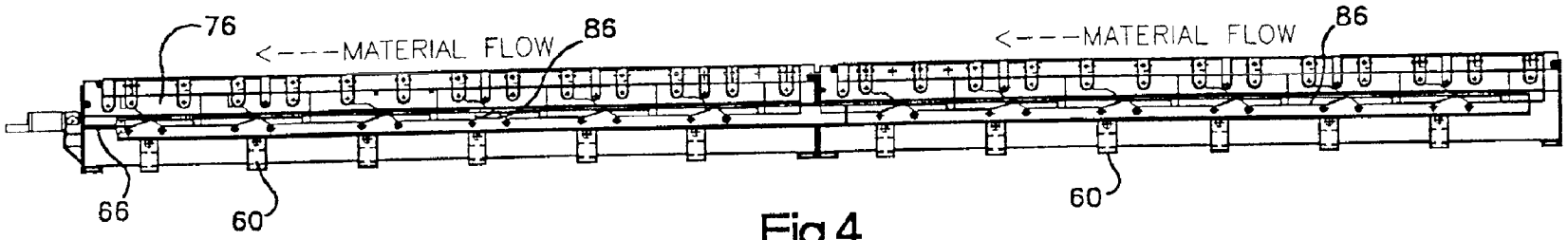
FIG. 4 is a side elevational view of the cutting station conveyor.
Figure 5:
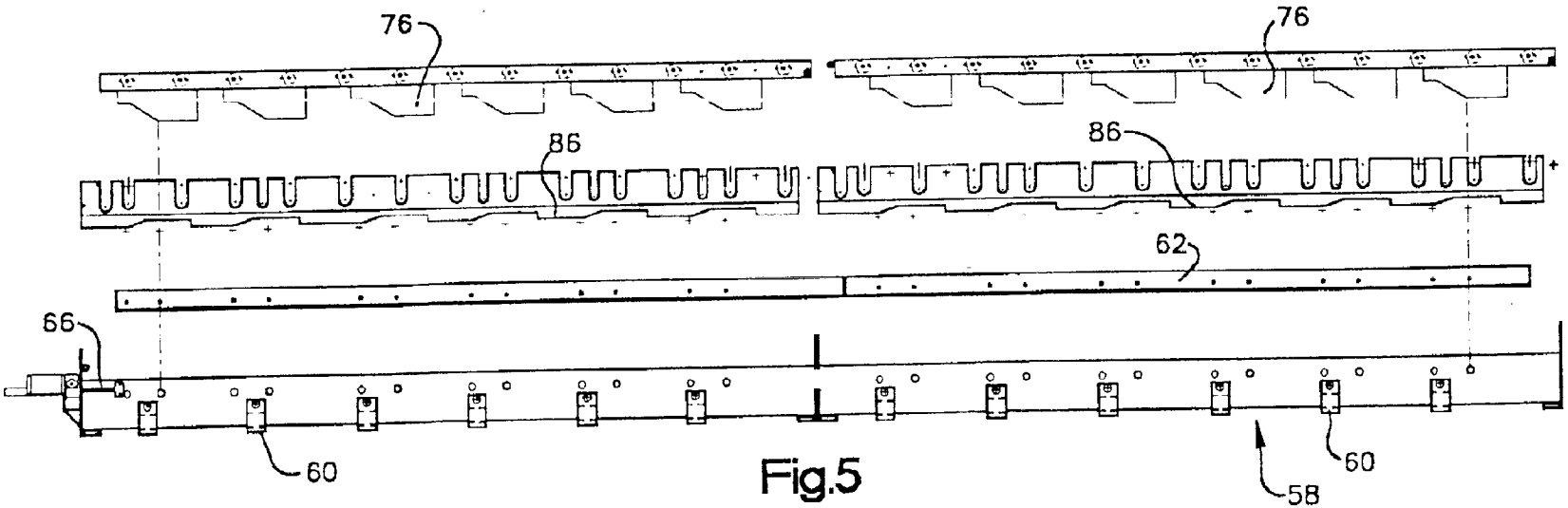
FIG. 5 is an exploded view of the cutting station conveyor of FIG. 4.

A preferred cutting station conveyor 38 is generally shown in FIGS. 3 and 4. The conveyor includes a frame with a plurality of base members 60 at the periphery of the table each being designed to rotatably carry a vee-shaped roller 64. For clarity, only a few of the base members are labeled in FIG. 5. A cam roller bar 62 is disposed on either side of the table and is movable longitudinally on the vee-shaped rollers in a direction of the length of the table. A screw 66 (one of which is shown in FIGS. 6A–8A, engages each of the cam bars to move them in first and second directions generally horizontally along the length of the table on the rollers 64. One of the screws is driven with a conventional electric motor 67 which is actuated in a known manner. The other screw is connected via an output shaft from the first screw (not shown) and simultaneously driven with the first screw in a known manner. Instead of screws, the cam bars may be driven in other ways such as using a hydraulic cylinder, rack and pinion and the like.

Figure 6B:
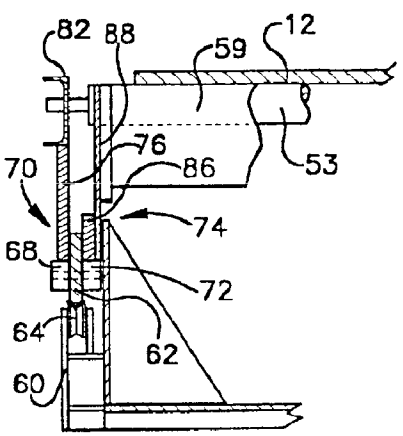
FIGS. 6A, 6B, 7A, 7B, 8A, 8B and 9 are side elevational views of the cutting station conveyor during operation.

Each of the cam bars carries outer rollers 68 which are adapted to engage a conveyor roller carrier assembly 70 and inner rollers 72 which are adapted to engage a slat carrier assembly 74 (see FIG. 6B). The roller carrier assembly 70 includes a plurality of longitudinally spaced side roller cam plates 76 which have lower flat surfaces 78, an inclined or cam surface 80 extending upwardly from the lower flat surface and upper flat surfaces 81. The cam surfaces affect the amount by which conveyor rollers 53 are raised or lowered. The lower surfaces result in the highest position of the conveyor rollers while the upper surfaces result in the lowest position of the conveyor rollers. The side roller cam plates are connected to an elongated roller support member 82 extending along the length of side of the table. The conveyor rollers 53 for moving the web plate are carried by bearings so as to extend between the conveyor support members 82, in a conventional manner.

The slat carrier assembly 74 includes elongated cam plates 86 that extend along the length of each side of the table in position to engage the inner rollers 72 of each cam bar. Side plates 88 extend upwardly from the cam plates 86 and include vertical slots 90 which receive the conveyor rollers therein and permit vertical movement of the conveyor rollers without inhibiting vertical movement of the slats. Slats 59 are connected between the side plates 88 across the width of the table. Each of the cam plates of the slat carrier assembly comprises a lower flat surface 94, an angled or cam surface 96 extending upwardly from the lower flat surface and an upper flat surface 97. The cam surfaces 96 affect the amount by which the slats are raised or lowered. The lower surfaces 94 result in the highest position of the slats while the upper surfaces 97 result in the lowest position of the slats. The upper surfaces 81, 97 (FIGS. 7A and 10A) support the slat carrier assembly and the conveyor roller carrier assembly on the cam bar rollers when in their lowest positions, whereas the lower surfaces 78, 94 support the slat carrier assembly and the conveyor roller assembly on the cam bar rollers when in their upper positions.

It should be appreciated that other arrangements of the cam bar rollers and slat and conveyor roller carriers may be possible. For example, both first and second sets of rollers may be disposed on one side of each cam bar and spaced transverse to the bar by different distances. The conveyor roller carrier assembly and the slat carrier assembly would then be on the same side of the cam bar and spaced transversely therefrom by different distances suitable for engaging the first and second sets of rollers, respectively. In addition, it may be possible for the conveyor roller carrier assembly and slat carrier assembly to include the cam surfaces without the upper or lower surfaces. The cam bar rollers would place the conveyor rollers and the slats at an elevated position when they are at a low position of the cam surfaces and would place the conveyor rollers and slats at a low position when they are at a high position of the cam surfaces. In this regard, if needed, stop members could be disposed on upper and lower positions of the cam surfaces.

Figure 7B:
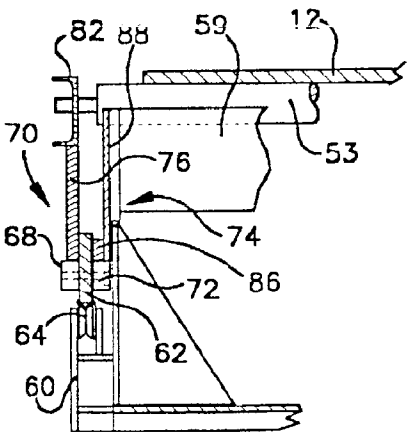
Figure 7A:
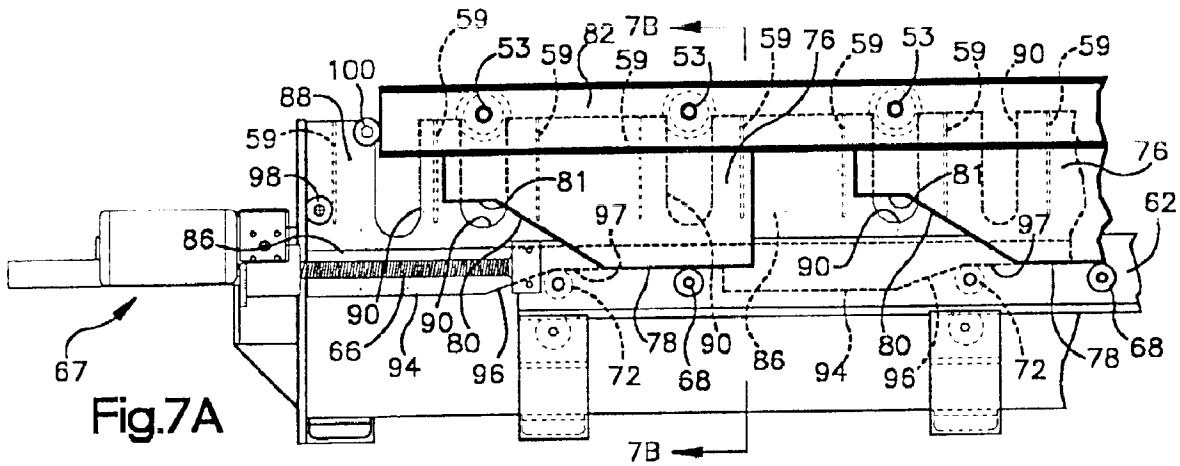
Figure 8B:
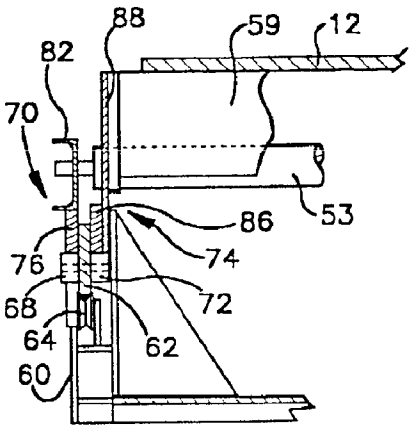
Figure 8A:
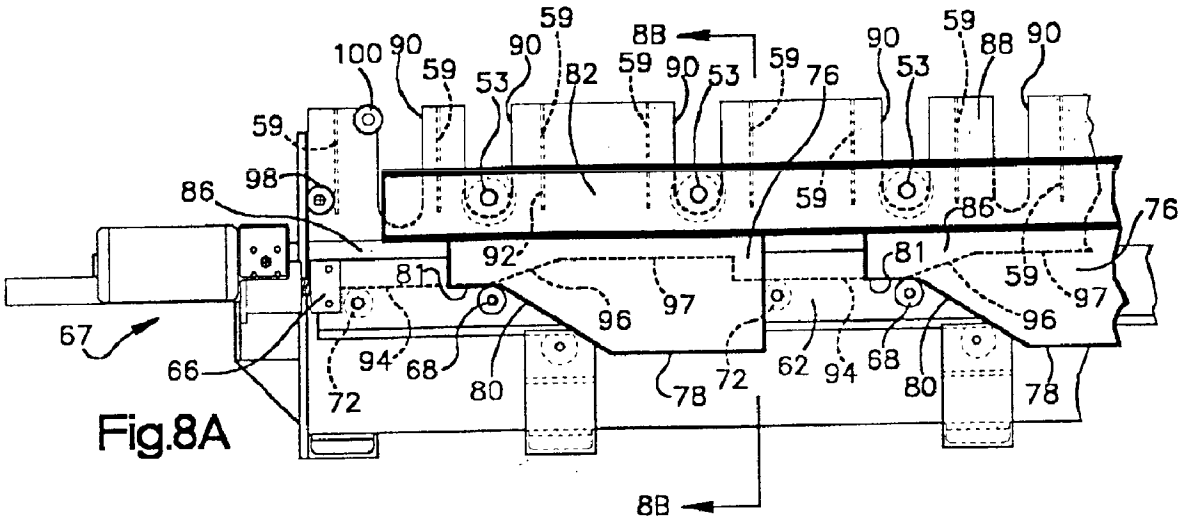
Figure 9:
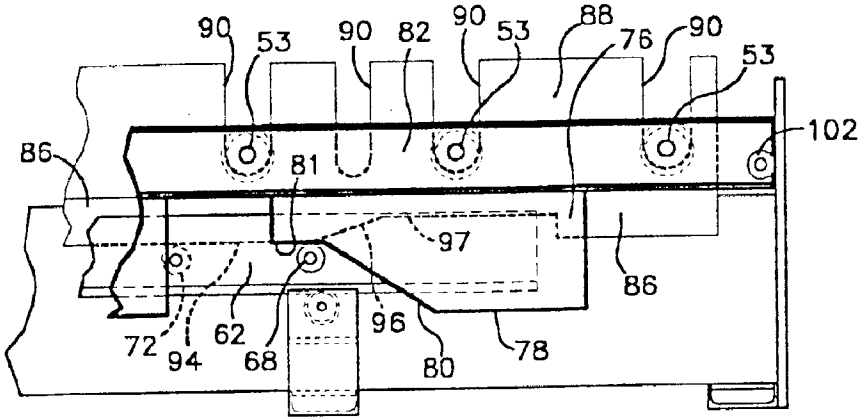

Referring to FIGS. 6A–8A and 9, the manner in which the conveyor roller carrier assembly and slat carrier assembly are constrained to vertical movement is shown. Attached to the slat side plates 88 are end plate engaging rollers 98. Also attached to the slat side plates at a higher location than the rollers 98 are rollers 100 for engaging the conveyor carrier roller support members 82 when they are in an elevated position. Attached to the support members 82 at the other end of the table are side plate engaging rollers 102 (FIG. 9). These rollers enable the support members 82 to engage the side plate when they are at a lower position. The side slat plates 88 are always in engagement with the side plate of the table via the end plate engaging rollers 98 and the conveyor roller carrier support members 82 are always in engagement with the side plate via the rollers 102. The rollers 100 engage the support members 82 when they are in an elevated position. Therefore, the conveyor roller assembly and the slat carrier assembly are prevented from axial movement and are limited to only vertical movement.

Figure 10C:
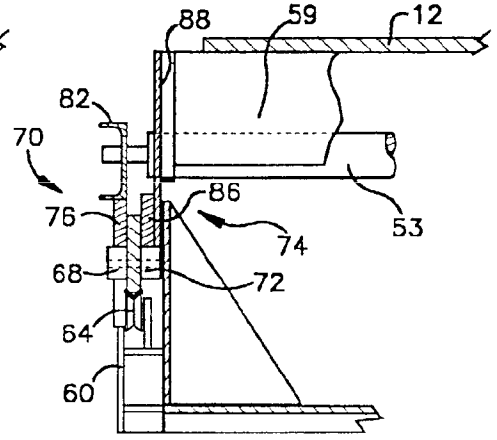
FIGS. 10A–10C are side elevational views of a first stroke of the cutting station conveyor.
Figure 10B:
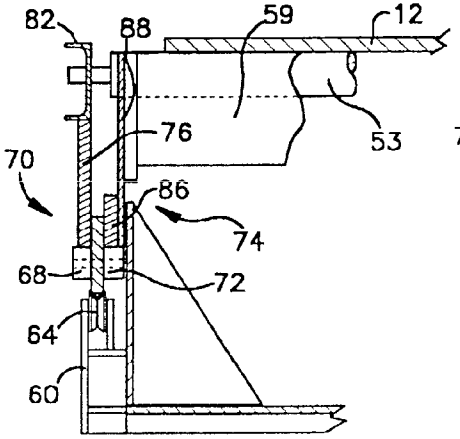
Figure 10A:
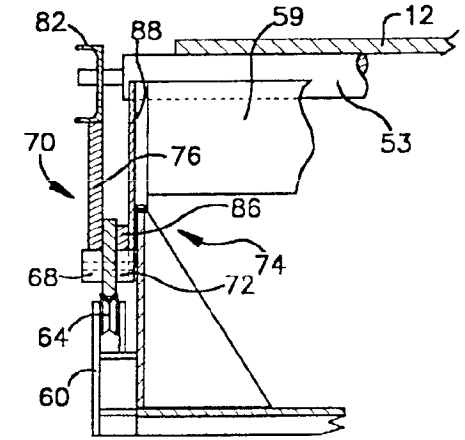

In operation, the web plate, preferably in the form of the continuous web plate 16, is conveyed toward the cutting station along the conveyor rollers 53 when the cam bars are extended farthest right as shown in FIG. 7A. At least one of the conveyor rollers may be motor driven. For ease of explanation, this will be referred to as a starting point of the forward stroke, although those skilled in the art may envision other sequences of operating the cutting station conveyor and designs of the roller and slat supports in which the highest roller position shown in FIG. 7A is not the starting point of the forward stroke and in which different degrees and timing of raising and lowering of the slats and conveyor rollers may be achieved. The forward stroke of the process is shown in FIGS. 10A–10C.

At the starting point of the forward stroke, the outer rollers 68 carried by the cam bar 62 engage the lower flat surface 78 of the conveyor roller cam surfaces 80, placing the roller support member 82 and thus the conveyor rollers 53, at the highest level, which is shown in FIGS. 7A and 7B. At this point the inner rollers 76 of the cam bars are disposed to the farthest position right as shown in FIG. 7A, against the upper surfaces 97 of the slat carrier assembly. This locates the slat side plates 88, and hence the slats 59, in their lowest position in which the slats 59 are below the top surface of the conveyor rollers 53 and do not engage the web plate 12.

Figure 6A:
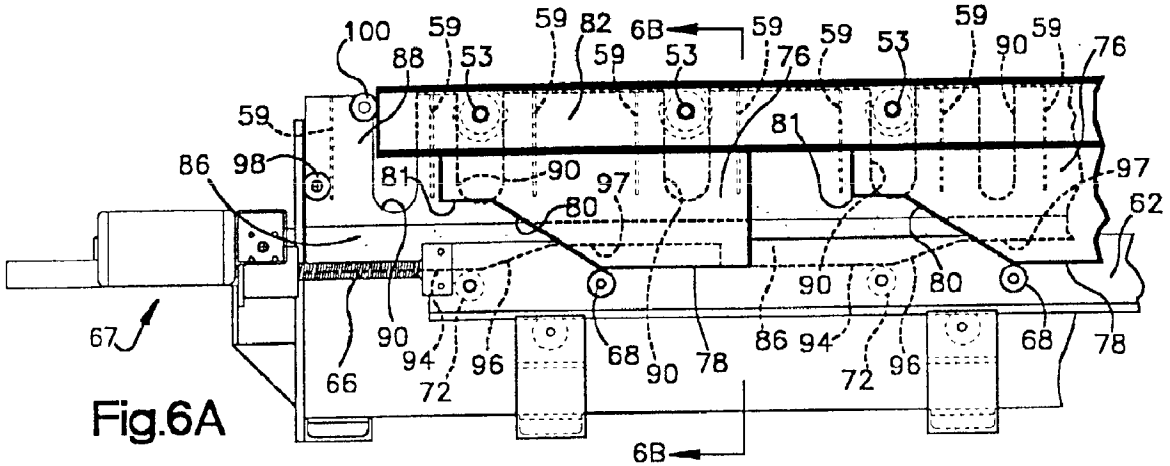

In preparation for cutting the webs from the web plate 12 it is desired to raise the web plate onto the slats 59 and to move the conveyor rollers away from the slats so that, in the event of a misalignment, the cutting machine will cut the slats, not the conveyor rollers. To achieve this, the screw is driven so as to move the cam bars toward the left as seen in FIGS. 6A and 6B. Of course, those skilled in the art will appreciate that terms used in this disclosure such as left, right, up, down, forward and return, are used for the purpose of illustration and should not be interpreted to limit the invention. The cam bars will be moved so that the outer rollers are at a location shown in FIG. 6A, in which they begin to engage the conveyor roller cam surfaces 80 while traveling toward the left. At this point the inner rollers of the cam bars travel downwardly along the slat carrier cam surfaces 96 moving to the left, toward the lower surfaces 94 of the slat carrier as shown in FIG. 6A. This raises the slats carried by the side plates 88. In the position shown in FIG. 6B the table is at a transition point of the forward stroke at which the slats 59 and conveyor rollers 53 are at approximately the same height, due to the lower conveyor roller surface 78 and the slat carrier lower surfaces 94 being at about the same height as seen in FIG. 6A.

Continuing the forward stroke further raises the slats and lowers the conveyor rollers from the position shown in FIG. 6A to the position of FIGS. 8A, 8B at the end of the forward stroke and transfers the web plate 12 from the conveyor rollers onto the slats. At the end of the forward stroke shown in FIG. 8B the slats are at their highest level, the conveyor rollers are at their lowest level and the cam bar has moved furthest left.

In the process of movement of the screw from the transition point of the forward stroke shown in FIGS. 6A, 6B to the final point of the forward stroke shown in FIG. 8A, the outer rollers travel upwardly toward the left along the conveyor roller cam surface 80, which lowers the conveyor rollers until they reach the locations shown in FIG. 8A near the bottom of the vertical slots. In the position shown in FIG. 8A the outer rollers contact the upper surfaces 81 at the end of the forward stroke. As a result, at the end of the forward stroke the conveyor rollers are at their lowest point.

Movement of the cam bars from the transition point of the forward stroke shown in FIG. 6A to the end of the forward stroke shown in FIG. 8A simultaneously moves the inner rollers from on or near the slat cam surfaces 96 to the left, which positions the inner rollers beneath the lower slat carrier surfaces 94, thereby placing the slats in their highest position as shown in FIGS. 8A and 8B. The downward movement of the conveyor rollers, responsive to movement of the outer rollers upwardly along the cam surfaces 80, is able to occur in view of the slots in the slat plate which receive the conveyor rollers. The extent by which the height of the conveyor rollers is lowered during the forward stroke from the transition point (FIG. 6A) to the end of the forward stroke (FIG. 8A) is relatively great compared to movement of the slats in this period. This is to ensure adequate clearance between the slats and the conveyor rollers when cutting takes place.

The webs are cut from the web plate 17 while the cutting station conveyor is at the end of the forward stroke, at which time the slats are in their highest position and the conveyor rollers are in their lowest position (FIGS. 8A and 8B). After cutting, it is desirable to lower the cut web plate back onto the conveyors so as to convey the webs to the outfeed conveyor for separating the webs from the scrap.

Figure 11C:
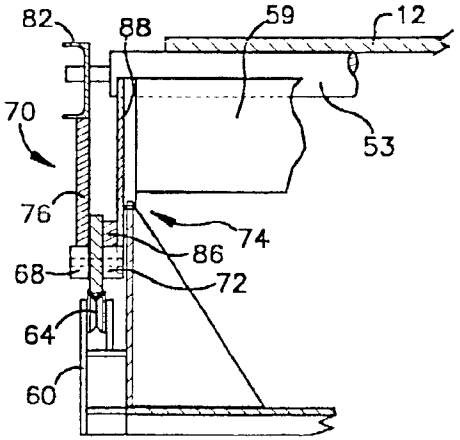
FIGS. 11A–11C are side elevational views of a second stroke of the cutting station conveyor.
Figure 11B:
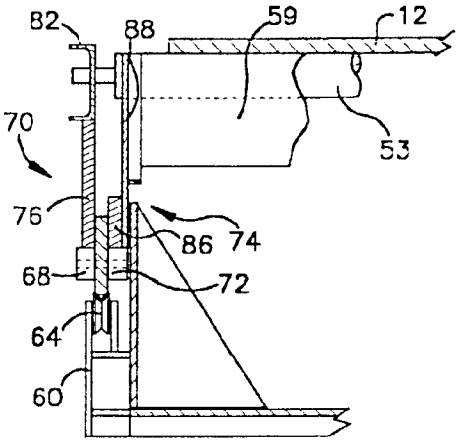
Figure 11A:
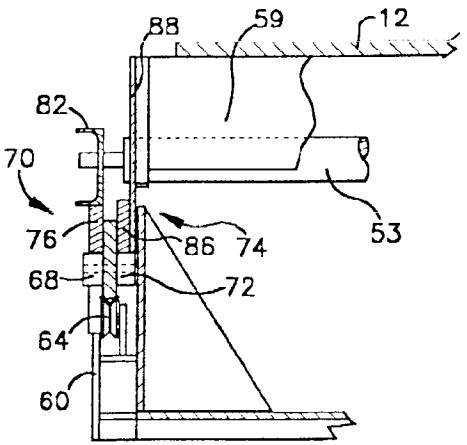
Figure 12:
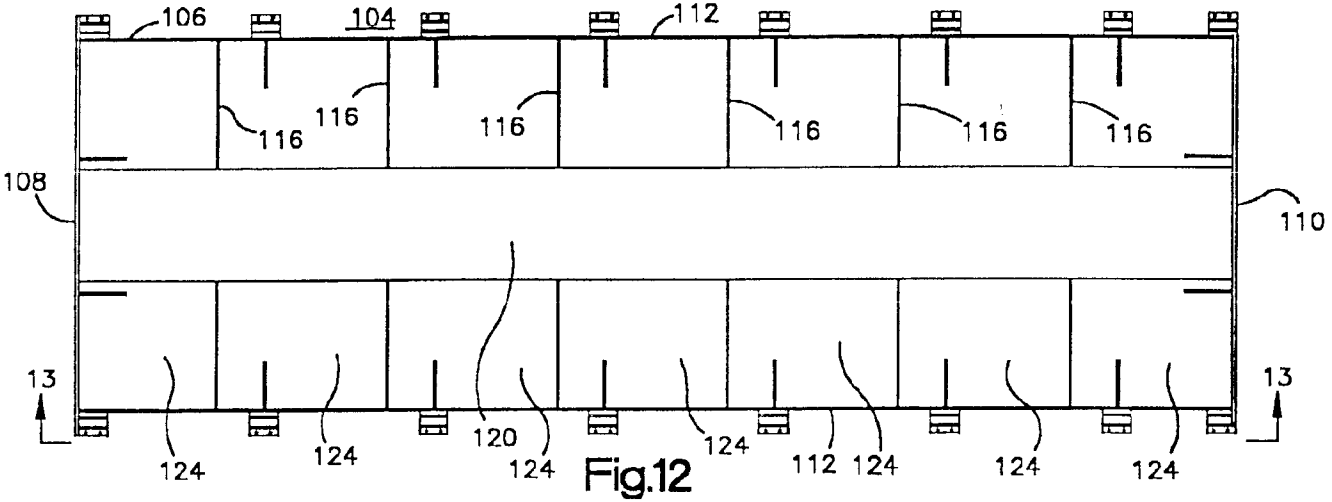
FIGS. 12–16 are views showing an exhaust system of the cutting station conveyor.
Figure 13:
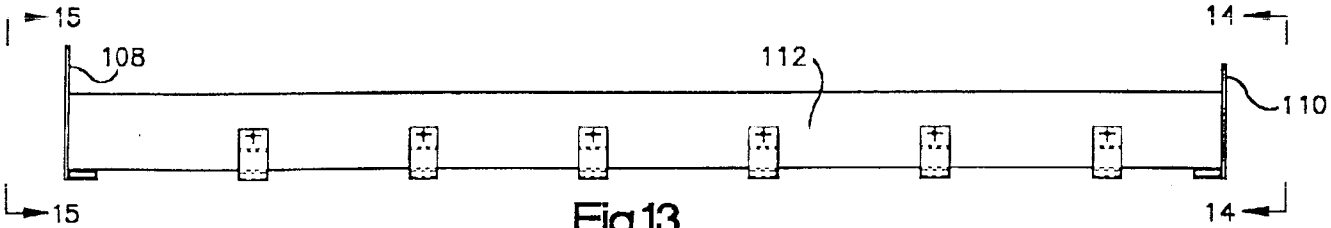
Figure 16:
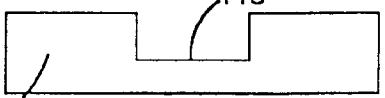
Figure 15:
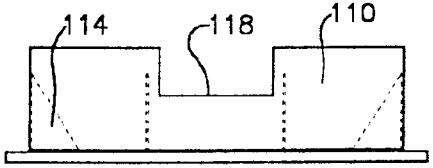
Figure 14:
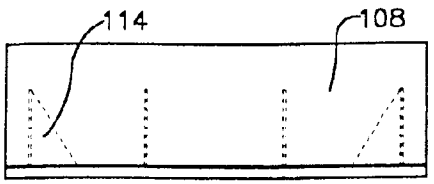

In the return stroke shown in FIGS. 11A through 11C, the screw is moved so as to move the cam bars from the farthest left position shown in FIG. 8A toward the farthest right position shown in FIG. 7A. The movement of the cam bars between these points will position the inner and outer rollers into the transition point shown in FIG. 6A.

Between the begining position of the return stroke (FIG. 8A) and the transition point of the return stroke (FIG. 6A), movement of the cam bars to the right begins to raise the conveyor rollers 53 by moving the outer rollers downwardly on the roller cam surfaces 80 toward the right. This lifts roller cam plates 76, thereby raising the conveyor rollers. The height of the slats is unchanged or somewhat lowered in this period as a result of the inner rollers of the cam bars moving along the lower slat surfaces 78 (FIG. 8A) and just beginning to travel onto the slat cam surfaces 96 (FIG. 6A).

Once the inner and outer rollers are at the transition point of the return stroke, the rollers and slats have been moved to about the same height as shown in FIGS. 6A, 6B. Support of the cut webs is transferred from the slats to the conveyor rollers. Further movement of the cam bars to the right from the transition point (FIG. 6A) to the position farthest right (FIG. 7A) will move the outer rollers onto the conveyor roller lower flat surfaces 78 which moves the conveyor rollers somewhat higher than the position in FIG. 6A (if at all) to the position shown in FIG. 7A, which is the highest position of the conveyor rollers.

At the same time, movement of the cam bars from the transition point (FIG. 6A) to the end of the return stroke and starting position (FIG. 7A) will move the inner rollers so as to travel upwardly along the slat cam surfaces 98 from the lower surfaces to the upper surface. As a result, the slats drop to their lowest position from the transition point (FIG. 6B) to the end of the return stroke (FIG. 7B). The extent of the lowering of the slats is sufficient if the slats are just low enough not to interfere with movement of the webs and scrap on the conveyor rollers.

At the end of the return stroke in the position shown in FIG. 7A, the cut web plates (e.g., webs and scrap) are now supported on the conveyor rollers 53 alone. Drive rollers of the conveyor rollers 53 are activated in a conventional manner to move the cut webs from the cutting station conveyor to the exit conveyor 40. While the cutting station conveyor is at the start of the forward stroke (FIG. 8A), the drive rollers of the cutting station conveyor are then activated to move a new portion of the continuous plate into position on the conveyor rollers, and the process is repeated.

The plasma cutting station conveyor 38 is equipped with an exhaust system for removing exhaust fumes created by cutting the steel plate. One suitable exhaust system 104 used in the present invention is shown in FIGS. 3, 3A and 14–17. The exhaust system includes a table 106 comprising end plates 108, 110 and side plates 112 extending along the length of the table between the end plates. The end plates include suitable bracing 114. Intermediate plates 116 extend across the width of the table between the side plates and are spaced along the length of the table. The end plate 114 and the intermediate plates 116 include U-shaped central portions 118 in which a ventilation duct 120 is received. The duct is connected near plate 110 to a baghouse with a filter bank (not shown).

A plurality of air valves 122 are connected to the side of the table, one of which is shown in FIGS. 3 and 3A. Each air valve is located in a zone 124 of the table and is connected by a pneumatic line to a pneumatic cylinder 126 which is mounted to the table. Any four-way valve may be employed in the present invention as the air valve 122, which is actuated by a cam type actuator, plunger mechanism, microswitch with electric air solenoid, or the like. One such suitable valve is a Schrader Bellows four-way valve, Part No. 520A1 1000. The duct includes a door 128 connected at a lower surface of the duct at a hinge 130. A bracket 132 is connected to a leg 134 of the plasma cutter so that when the plasma cutter moves to a different zone, the bracket rides on a roller of the air valve in that zone to open or close the valve, which in turn actuates the corresponding pneumatic cylinder. When the cutter enters a zone, the valve is opened and the pneumatic cylinder opens the corresponding door at the bottom of the zone. The suction air flowing through the duct pulls in fumes from that zone, while not in other zones remote from the cutter.

Other exhaust apparatuses may be suitable for use in the present invention. One such suitable exhaust apparatus is a Zephyr downdraft exhaust table which is commercially available from MG Systems and Welding Co.

Referring to FIG. 3, movement of the plasma cutting machine 36 to cut webs from the web plate is directed by a suitable nesting software program. A PC based plasma cutting machine controller 134 downloads the nest as prepared by the nesting software. The plasma cutting machine comprises a gantry 36*a* and torch 36*b*. Suitable torches are a PT-19XLS torch made by Easob and a Hypertherm HT 2000 torch made by Hypertherm Inc. Suitable gantries are an MG Titan gantry made by MG Industries, an Easob Avenger gantry made by Easab Cutting Systems Inc., and a Phoenix gantry made by Farley. The plasma cutting gantry travels on tracks 136 disposed alongside each side of the cutting table along its length and a torch holder moves in directions perpendicular thereto in a known manner to cut a desired nest or grouping of webs from the web plate. An oxygen plasma or high definition oxygen plasma cutting machine is preferred. The plasma torches may employ one or more of oxygen, nitrogen or shop air as the cutting gases. Those skilled in the art will understand in view of this disclosure that cutting machines other than the oxygen plasma cutting machine described may be employed in the inventive system, such as a cutting machine with an oxygen acetylene torch. Other cutting devices may also be used such as a laser.

After the webs have been cut from the web plate, the webs and scrap material are transferred by the conveyor rollers 53 onto the exit roller conveyor 40. The webs and waste are separated from each other on the exit conveyor.

The system may include two or more continuous plate forming systems. For example, a second infeed roller conveyor 138 extends from the web plate storage table 26 to a second seaming station 140. A second cutting station 142 extends from the second seaming station to a second exit conveyor 144. A second plasma cutting machine 146 is disposed along a second cutting station conveyor 147. The second continuous plate forming system operates in the same manner as the first continuous plate forming system. In addition, more than one beam fabrication system or component of the system other than what is shown in the drawings may be interfaced with production control, these systems being located in the same or different facility.

Webs are made by both continuous plate forming systems. Webs are transferred from the exit conveyor 144 of the second continuous plate forming system to the exit conveyor 40 leading from the first continuous plate forming system or onto the beam line conveyor 42.

Engineering inputs beam fabrication data Bd to a PC server 148 at production control 150 indicative of all of the information needed to make flanges, webs, plates and other detail parts needed to make beams, as well as the sequence in which the webs and flanges should be made. The server 148 is loaded with the nesting software. Suitable nesting software packaging are Pronest nesting software by Microcomputer Technology Consultants and Sigmanest nesting software by Sigmatek.

Electrical web fabrication signals (Wfs) are sent from the production control server 148 to PC based machine controllers 134*a*, 134*b* which are located on each plasma cutting machine. The Wfs indicate the sizes (shapes) of webs to be produced at the plasma cutting station and the sequence in which the webs are to be transported from the plasma cutting station to the beam line. In a preferred embodiment, the cutting station operator only makes the indicated sizes (shapes) of webs in the sequence indicated by production control into other sizes (shapes). Electrical flange fabrication signals (Ffs) are also sent from the production control server 148 to PC based machine controllers 154*a*, 154*b* located on each flange line indicative of the size of flanges needed and a flange discharge sequence in which the flanges are to be discharged from the flange station so as to correspond to the web discharge sequence. The Ffs indicate the corresponding flanges that need to be produced to be matched with the webs that will be arriving at the beam line and may take the form of a flange sequence which is based upon the web discharge sequence or it may take the form of the web discharge sequence itself. The Ffs are limited to the Wfs that have been downloaded or are available for downloading at the PC based plasma cutting machine controllers 134*a*, 134*b*. A steady stream of all of the information about the beams to be fabricated is not available to the flange line controllers 154*a*, 154*b*. The operator of the flange line types in a job number, for example at the PC based flange line controllers, and will receive Ffs regarding the sizes of all flanges needed to make beams of that job and the sequence in which the corresponding webs will be discharged from the cutting station. The Ffs information will be available sequentially. For example, the flange line operator will not be able to access information regarding flange Nos. 204 and then flange Nos. 306. His information will be limited to flange Nos. 204, then flange Nos. 205 and so on until flange Nos. 306 are reached in the order. In this way he will be prevented from making flanges that do not correspond to the order of webs discharged from the web cutting station.

Electrical detail parts fabrication signals (Dfs) are sent to the detail parts station 27 indicating the detail parts needed for attachment to the beams produced at the beam station. The detail parts are preferably run in advance due to the large number of detail parts. However, detail parts production would be limited to fabrication of detail parts according to job priority, rather than being permitted to make detail parts for jobs outside the sequence dictated by production control.

After the web fabrication signals Wfs are sent to the cutting stations 18, 142, the operator instructs the web gantry to obtain the first web plates of desired size identified by the Wfs. These plates are sent to infeed conveyors 30, 138 and then to the seaming stations 14, 140. The operator then selects second plates of the same size, which are sent in the same manner to the seaming stations 14, 140. The first and second sets of plates are welded together end-to-end and travel on the conveyor rollers to the cutting stations 18, 142. It will be understood that the first and second cutting stations may not need to be strictly synchronized. The web fabrication signals Wfs, including nests of webs prepared by the nesting software at production control, are downloaded onto the controllers 134*a*, 134*b*, and instruct the plasma cutting machine to cut the desired webs from the continuous web plate. Additional plates are seamed onto the end of the last plates as needed. After the webs have been cut at the cutting stations 18, 142, they are inspected and sorted on the exit conveyors 40, 144 into the sequence instructed by the web fabrication signals Wfs. The sorted webs are sent down the beam line 42 in that sequence.

After receiving the flange fabrication signals at the PC based flange line controllers 154*a*, 154*b* the flange line operator makes the flanges of the indicated sizes (shapes) and sequence. The controllers 154*a*, 154*b* at the flange line download flange fabrication information directly from production control, which includes information regarding the length, width and thickness of the flanges, and the sizes and locations of openings therein. A gantry 155*a*, 155*b* is used at each flange line for obtaining the needed bar stock material for making flanges. At the flange station, flanges are made by welding stock together end-to-end as needed and cutting to size, in the conventional manner. One suitable controller 154 at the flange line is a CNC 500 made by ASC Machine Tool. The flanges are matched with the corresponding web in the order in which the web arrives at the beam station. The outfeed conveyor 25 extends from the flange line to transfer the flanges to a tack station 158 along the beam line conveyor. The flanges travel on the flange outfeed conveyor in the sequence corresponding to that of the webs traveling down the beam line to match the flanges with the appropriate web.

At the beam line after obtaining the appropriate flanges corresponding to the next web to arrive, an inner and an outer flange is positioned on the beam line conveyor to extend generally vertically on each side of the horizontally extending web. The web is moved to a midpoint of the flanges and tack welded in place in the known manner.

The tack welded web and flanges then travels along the beam line to a beam welding station 160 located along the beam line where a beam welding machine is used to weld the flanges to the web along the entire length of the web. One suitable apparatus for beam welding is Franklin Model PTW-72, horizontal welding machine with two weld heads for welding each of the flanges to the web, which includes two DC 1000 power supplies made by Lincoln. Another suitable beam welding machine is AWM Automatic Welding Machine 72-102 by PHI.

The detail parts fabrication signals Dfs are sent to the detail parts station 27 for making plates and other parts to be attached to the beams to form finished beams. After the beams are welded at the beam welder they are matched with the detail parts made for them at the detail parts station and are transferred to another location for final fit up and welding.

For purposes of illustration, a nonlimiting example of the inventive web fabrication driven system for making beams will now be described.

EXAMPLE

A job order is placed by a builder and is received by engineering services. The job is engineered according to building requirements. Engineering releases the job, along with all others completed during the prior week, to production control. Production control processes the jobs received from engineering. Production control arranges each job on a job priority basis. This priority can be set either when the job order is placed or by contacting the builder prior to releasing the job to the shop.

Production control runs a separate sort for each job. Sorts consist of breaking the job into different groups of data. Each group of data will be used to drive different manufacturing equipment, i.e., one sort will be for the flange lines, one sort will be for the plasma cutting process and one sort will be for detail parts including the plate fabricator. The term detail parts means all parts which are attached to the beam. The driving factor for the sorts will be the web cutting process. A job number and a sequence number will be assigned to each web and then corresponding flanges and detail parts will be marked according to those numbers.

Webs are nested by production control. The term "nest" herein has its customary meaning and refers to arranging and spacing of webs to be cut from a plate of web stock to efficiently utilize the web stock. However, the webs are nested on the continuous plate instead of on individual plates of web stock Webs for an entire job are nested together in an attempt to achieve maximum plate utilization. When desired plate utilization is no longer achieved by using webs of only a single job, webs from the job of next highest priority may be pulled down to help achieve desired plate utilization. The terms "desired plate utilization" used herein mean the nesting of webs on a plate in such a way as to minimize waste material, such as in the form of end drop (Waste material at the end of a plate). This will be a continuous process with the overlapping of jobs to attain desired plate utilization. Job priority and plate utilization will be the driving factors for overlapping jobs. Nesting software allows webs to be nested on an unending length of plate and the plate cut where needed to achieve best utilization. This eliminates the need for stocking several lengths of plate. This will also reduce the number of multiple piece webs that are produced, thus reducing the amount of seam welding required on the beam line. Multiple piece webs are assigned the same sequence number followed by a letter, starting with "A" and proceeding alphabetically. Production control stores processed sorts on a production control server. Production control releases Fabrication Shop Drawings (FSD's), job and sort lists to the shop. Sorted data is ready to be downloaded to the plasma cutting station, plate fabricator and flange lines. However, data are pulled down in a sequential order. Therefore, all lines will be working on the same data.

As an example of efficient plate utilization, if a 3/16" thick by 60" wide plate is used and a 34" wide web is to be cut from it with no other web from that job being desired to be placed in that nest, in order to maximize use of the full width of the plate, a 3/16" thick web from the job of next highest priority can be nested on the plate. If such a web having a width of about 26" is needed in the next job, nesting it beside the 34" web will achieve maximum utilization of the width of the plate. Production control may instruct that the sequence of webs to be sent to the beam line in the case where webs of different jobs are in the same nest, is to send the web from the first job to the beam line and then behind it to send the web from the second job to the beam line. This would result in minor mixing of jobs and is preferred since it avoids building stacks of the different priority webs. On the other hand, production control may instruct the web from the second job to be stacked so as to process all of the webs from the first job at once, as in the case when there is a need to have the first job done quickly.

There usually will be more than one web in each nest. Since production control will specify the order in which the webs are to be sent to the beam line, a worker will sort the webs cut at the exit conveyor of the plasma cutting station into the order specified by production control before the webs are sent to the beam line.

Fabrication parts are produced in the manufacturing facility. A detail parts cut list is released to the shop. A plate fabricator 162 has been installed to carry out much of the work in the detail parts area. It has a PC based machine controller 164 capable of downloading plate size and sequence directly from production control. Downloads to the plate fabricator will be available sequentially to match the manner in which work is being processed on the plasma and flange lines. However, due to the number and complexity of the detail parts, the plate data may be made available to the plate fabricator as much as two days in advance of the plasma and flange lines. The other operations of the detail parts area will function in a conventional manner. However, the plate fabricator will be the "workhorse" for making detail parts and will shorten fabrication time for detail parts. The plate fabricator downloads data from the production control server. An operator reviews the data, sets the punch portion of the plate fabricator up with the proper size punches and starts the cycle. The gantry for the plate fabricator automatically retrieves the proper size of bar stock material for the job from a pre-programmed bin location and places the bar on the plate fabricator conveyor. The machine then locates the end of the bar and begins producing plates. The plates are punched, marked with sequence numbers and cut to length. The operator performs a quality check on the plates and stages them for use. The plate fabricator is fitted with a weld splice. This allows the machine to be fed with an endless piece of bar stock. This is accomplished by welding the leading edge of one bar to the trailing edge of the next. This eliminates end drop that would be produced on each bar if the bars were not welded.

The PC based cutting station controller and PC based flange line controller download information directly from the production control server. Not all of the information will be available at any instant. The information downloaded will only be available in a sequential order. This prevents a line from jumping through the production schedule. Each machine can be kept in time with the others by controlling the ability for them to download information from the production control server.

The controllers 134*a*, 134*b* download a nest from the production control server 148. The material size, length and thickness needed for the nest, is noted in the downloaded data. The plasma operator then uses an automatic programmable gantry to retrieve the proper plate from stacks of material. The gantry places the material on the entry conveyor. Hydraulic guides can be used to align the part on the conveyor. The plate can then be indexed to place the trailing edge of the plate in the seam welder hold down clamp. At this time, the next plate can be retrieved from the storage bins using the web gantry. The leading edge of the second plate can be conveyed under the damp of the seam welder. These two edges can then be welded together to form essentially an endless piece of plate. The entire plate can then be indexed onto the bum area of the plasma table conveyor and the web nest cut. The cut nest would then be indexed to the exit conveyor 40 where the skeleton can be removed. The process can continue with the leading edge of each new plate being welded to the trailing edge of the previous plate. The cut nest will have the skeleton removed and will be placed on the beam conveyor 42.

The web data download will be fed to the plasma stations starting with the largest material thickness. This will allow only one piece of drop at the end of a job cycle. This drop will be where the plasma has cut the final nest from the thinnest material and must start the cycle over with the thickest plate. For example, if ⅜" thick plate is the largest thickness plate of a job, it is nested and webs are cut from it first. Once all of the webs are cut from the ⅜" thick continuous plate, the next thickness plate of the job, for example, ¼", is seamed to the end of the continuous ⅜" plate. There may be an unused portion of the ⅜" thick plate that otherwise would be end drop. This portion of the ⅜" plate is utilized in dual ⅜", ¼" webs cut from both the ⅜" and ¼" plates. The fact that the web has the larger ⅜" thick portion presents no structural problems for its intended application in a beam requiring a ¼" web or in the case when the ⅜" material is an excessive thickness for the application and ¼" thickness will do.

The PC based flange line controller 154 downloads flange fabrication data from the production control server 148. This data will be "timed" through the use of the production control server to match with the webs that are being cut and sent down the beam line. In other words, production control specifies the sequence and size of flanges that are required to match the webs that are being sent down the beam line. The operator of the flange line makes the next flange in the size and order dictated to him by production control. The flange line operator preferably does not decide which flanges to make on his own and does not make stacks of flanges which would be stored until ready for use, although some flanges may be sent to a staging area of the exit conveyor 25 of the flange line until used.

The data regarding the necessary sizes and sequence of flanges is sent from production control to the PC based flange line controller. The operator sends an automated gantry to a particular material storage bin to retrieve the proper size of bar stock material needed to fabricate the flanges. The gantry will place the material on the infeed conveyor. The machine can then find the leading edge of the material and begin building the flanges. The flange line is equipped with a weld splice station that allows the trailing edge of one bar to be welded to the leading edge of the next in order to have an endless piece of bar stock and reduce end drop. Once the flanges are built and marked, they will be conveyed to the beam tack station along the exit conveyor.

In one particular example, production control requires the production of 50 webs for a job. Webs 1 and 48 are to be nested together on the continuous plate. The Wfs instruct the operator at the web cutting station to nest and cut web Nos. 1 and 48 together and to send them to the beam station with web No. 1 first and web No. 48 second. The flange line operator is sent the Ffs which instruct him as to the sizes of the pairs of flanges (inner and outer) that are needed to be matched with web Nos. 1 and 48 and that the webs will be sent to the beam line in the web discharge sequence of web No. 1 first and web No. 48 second. This requires sorting by the operator at the web cutting station and placing of web No. 1 first and web No. 48 second on the beam line conveyor (and so on for other webs in that nest or subsequent nests to follow the sequence intended by production control). The Ffs are available to the operator of the flange line preferably only after the Wfs are downloaded by the operator at the web cutting station. In this way, the flange line operator may not make flanges out of sequence and the flanges, once made, are in the order in which the webs arrive at the beam station.

The webs will be sent along the beam conveyor to the tack welder in the sequence directed by production control. The flange line will feed the tack welder with flanges in a just-in-time fashion based upon job priority. This will eliminate the need for flanges to be stacked, stored and retrieved.

The need for a seam welder on the beam line will be dramatically reduced through nesting an endless plate. Seam welding on the beam line should be reduced to only mixed thickness webs. The webs will be delivered from the plasma cutting station via conveyors to the seam welder. The webs will have been quality checked prior to arriving at the seam station. For example, it may be necessary to cut webs at the plasma station from different, unseamed plates. For that matter, a continuous plate is not an essential feature of the present invention. Driving beam fabrication by webs made at the plasma station and in terms of job priority rather than flange bar stock utilization, offers advantages even if all of the webs are made from individual, unseamed plates. That is, most of the webs would be formed from two or more plates, which would then be seamed together, preferably at the seaming station of the beam line. It may also be occasionally desirable to form webs from more than one unseamed plate even when using continuous plate at the plasma station. If the webs are not mixed thickness, they will be immediately transported on the beam conveyor past the seam station to the tack station.

At the tack station 158, the operator will have the proper flanges for the web delivered to him via a conveying system (e.g., the outfeed conveyor 25). The tack station operator will merely double check the flanges against the web and tack inner and outer flanges to each web in the usual manner.

After being tacked, the beam is transported to the beam welder 160 via the beam line conveyor 42. The flanges are then welded to the web with a submerged arc weld. A package containing the fabrication shop drawings ("FSD") is attached to the beam and the beam is then removed from the line and placed in a holding area to await being mated with detail plates and being moved to the weld area. It should be apparent to one skilled in the art in view of this disclosure that the package containing the FSD may be placed on the web sooner, such as on the webs after they are sorted after cutting at the plasma station.

It should also be apparent to those skilled in the art that, although less efficient, it is possible that a hardcopy of information (e.g., the FSD's) may be sent via production control to the plasma station, flange line station and detail parts station, in place of the electrical signals sent from the production control server. Alternatively, both a hard copy and electrical signals may be sent from production control to the cutting station, flange line station and/or detail parts station.

Detail plates which have been run and staged previously are mated with the beam using the sequence number. The beams are then ready to be moved to the finish weld area for final fit up and welding.

A comparative example of a conventional flange-riven beam fabrication process will now be described to illustrate the advantages of the present invention.

COMPARATIVE EXAMPLE

A job order is placed by a builder. The job order is received by engineering services and engineered in accordance with building requirements. Engineering releases the job, along with all others completed during the prior week, to production control. Production control processes the jobs received from engineering and breaks the jobs into what are referred to as fabrication parts, consisting of several jobs, so they will be easier to process through the shop.

Production control runs sorts for the parts, each of which consists of breaking the fabrication parts into different groups of data. Each group of data will be used to drive different manufacturing equipment, i.e., one sort will be for the flange lines, one for the plasma cutting process and one for detail parts. In the process of making sorts, the flange sort is the controlling factor.

The flanges are "sorted" in order to run all flanges of a given size at one time. In the past, changing material sizes at the flange line resulted in a significant waste of bar stock. For example, all of the bar stock of a given thickness was run at one time, even though it meant that several jobs were mixed together. The flanges are also assigned a sequence number. The webs and detail parts are sorted based upon their relationship with the flanges and sequence numbers are assigned that match the webs and detail parts to the flanges.

Webs are nested by production control. Webs for an entire fabrication part are nested together in an attempt to achieve maximum plate utilization. However, due to the fact that the webs must be placed in a sequence that matches them with their respective flanges based on the previously determined sequence number given the flanges, plate utilization is sometimes overlooked in order to reduce the number of web stacks the plasma crew is building. Webs are nested on a given size of plate, usually a 5'×15', 5'×20' or 5'×30' plate. The size is chosen to achieve best plate utilization. Based on the length of the webs and the length of plate they are run on, multiple pieces are cut to produce only one web. These multiple pieces are welded together in the fabrication process. Multiple piece webs are all assigned the same sequence number followed by a letter, starting with "A" and proceeding alphabetically. Production control stores processed sorts on a production control server. Production control releases the FSD's, part and sort lists to the shop. Sorted data is ready to be downloaded to the plasma and flange lines.

Fabrication parts are produced in the manufacturing facility. A detail parts cut list is released to the shop. These parts may be produced in a variety of ways. They may be cut using a shear or on the bum table. They may then be stacked and stored for use or they may need to have additional work performed in order to prepare them for use. The drilling or punching of bolting holes is the most common type of preparation work performed. This can be done by punching at the plate duplicator, at a single hole punch, or at a die or unipunch tooling set up in another press. The holes may also be drilled in the plates at a radial arm drill. Once the detail parts are produced, they are stacked according to a sequence number that mates them with the beam they will be used to produce. These stacks of plates are moved to a staging or holding area to await mating with beams.

Plasma and flange lines download information directly from the production control server. All information on the fabrication part (comprised of several jobs) is available to the lines at any time. Team leaders must coordinate with the operators to insure that each line is running the proper parts and the beam welder does not run out of work.

A PC based plasma cutting machine controller downloads nest data from the production control server. Part baskets are loaded onto the plasma water table. Plate stock is loaded onto the plasma baskets one piece at a time using an overhead crane. This plate stock is then cut into the proper shapes. The baskets with the parts are then removed from the plasma water tables using an overhead crane. These baskets are then set on the floor. Material handlers remove the cut webs and stack them according to their sequence number. The skeleton is removed using torches and discarded. Once a stack of webs is built, it will be set aside and stored until it can be used at the beam welder.

The flange line pulls flange sort data from the production control server. An entire bundle containing many pieces of the required size of bar stock will be staged at the infeed flange conveyor using an overhead crane. The flange line operator will run all of the flanges that require that size of bar stock. The operator will manually pull each piece of bar stock onto the infeed conveyor. The operator will then proceed running the flange line by running the first piece through the machine. The part will automatically stop to allow the next piece to be manually welded to it. This provides the line with an endless piece of bar stock from which to run flanges. These flanges are also marked with a sequence number that relates the web to them. Once the operator has run the flanges for that particular size he removes the bundle of flanges and stores them in a staging area. The remaining bar stock from the bundle is then removed from the line and stored in a holding area.

As work is needed at the beam welder, a material handler will retrieve matching stacks of webs and flanges and place them at the beam weld line. Webs do not travel down a roller conveyor all the way from the cutting station to the beam station and are not used at the beam line soon after they are cut since the flange line drives the web fabrication. Webs are placed behind the seam welder on staging racks and flanges are placed behind the tack station on staging racks.

The operator of the seam welder pulls webs from the staging rack onto the beam conveyor. If the web is more than one piece, the pieces are welded at the seam welder. The web is then transported via the beam conveyor to the tack station.

At the tack station, the operator pulls the flanges off the staging rack onto the beam conveyor. The operator then checks the sequence number of the web and insures that it matches the flanges. The flanges are then aligned and squared with the web and tack welded onto the web.

After being tacked, the web and flanges are transported to the beam welder via the beam conveyor. The flanges are then welded to the web with a submerged arc weld. A package containing the FSD is attached to the beam and the beam is then removed from the line and placed in a holding area to await being mated with detail plates and being moved to the weld area.

Detail plates which have been run and staged previously are mated with the beam using the sequence number. The beams are then ready to move to the finish weld area for final fit-up and welding.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of making steel I-beams comprising:

sending web fabrication information to a web cutting station indicative of web sizes needed for webs for the steel I-beams and indicative of a web discharge sequence in which the webs are to be discharged from said web cutting station, said web discharge sequence corresponding to a job priority;

cutting steel plate at said web cutting station to form the webs having the desired web sizes;

transporting the webs from said web cutting station to a beam station in accordance with said web discharge sequence;

sending flange fabrication information to a flange station indicative of flange sizes needed to make flanges for said beams and sending to said flange station a flange discharge sequence in which said flanges are to discharged from said flange station in correspondence with and based upon said web discharge sequence;

cutting steel stock so as to form said flanges having said flange sizes;

transporting said flanges to said beam station according to said flange discharge sequence so as to match said flanges with an associated one of said webs; and welding said flanges and said web together to form beams at said beam station.

2. The method of claim 1, said step of sending web fabrication information comprising:

transmitting electrical signals from a computer.

3. The method of claim 2, said step of sending flange fabrication information comprising:

transmitting electrical signals from a computer.

4. The method of claim 1, further comprising:

attaching parts to said beams.

5. The method of claim 1, said steel plate being a continuous steel plate having at least two steel plates welded together.

6. A method of making steel I-beams comprising:

sending web fabrication information to a web cutting station indicative of web sizes needed to make webs for the steel I-beams and indicative of a web discharge sequence in which said webs are to be discharged from said web cutting station, said web discharge sequence corresponding to a job priority;

cutting continuous steel plate at said web cutting station to form said webs having said web sizes, said continuous steel pate having at least two steel plates welded together;

transporting the webs from said web cutting station to a beam station according to said web discharge sequence;

sending flange fabrication information to a flange station indicative of flange sizes needed to make flanges for said beams and sending to said flange station a flange discharge sequence in which said flanges are to be discharged from said flange station in correspondence with and based upon said web discharge sequence;

cutting steel stock so as to form said flanges having said flange sizes;

transporting said flanges to said beam station according to said flange discharge sequence so as to match said flanges with an associated one of said webs; and welding said flanges and said webs together to form beams at said beam station.

* * * * *